US006105277A

United States Patent [19]

Lindberg et al.

[11] Patent Number: 6,105,277

[45] Date of Patent: Aug. 22, 2000

[54] PROCESS AND SYSTEM FOR PROMOTING COMPLETE WEB SUPPORT WITHIN THE DRYER SECTION OF A PAPERMACHINE

[75] Inventors: Kari Lindberg, Knoxville, Tenn.; Pekka Saarikivi, Raisio; Raimo Virta, Turku, both of Finland

[73] Assignee: Valmet, Inc., Charlotte, N.C.

[21] Appl. No.: 08/877,662

[22] Filed: Jun. 18, 1997

[51] Int. Cl.[7] ..... F26B 13/08

[52] U.S. Cl. ..... 34/456; 34/457; 34/458; 34/116

[58] Field of Search ..... 34/111, 114, 115, 34/116, 122, 123, 402, 403, 448, 453, 456, 457, 458; 162/202, 204, 207, 290

[56] References Cited

U.S. PATENT DOCUMENTS 4,553,340 11/1985 Petersson ..... 34/114
4,876,803 10/1989 Wedel ..... 34/117
4,905,380 3/1990 Eskelinen et al. ..... 34/457
5,279,049 1/1994 Skaugen et al. ..... 34/115
5,515,619 5/1996 Kahl et al. ..... 34/114

*Primary Examiner*—Pamela A. Wilson
*Attorney, Agent, or Firm*—Michael E. McKee

[57] ABSTRACT

A system (20) and associated process for use in the dryer section (18) of a papermachine for promoting complete support of the paper web (32) by the carrier fabric (34) as the fabric and web are transferred between adjacent drying cylinders (22, 24) by way of a turning roll (26) utilizes a blowbox assembly (50) positionable within the pocket region (40) bounded by the drying cylinders and the turning roll. The blowbox assembly is adapted to direct air out of the pocket region to reduce the likelihood of separation of the web from the carrier fabric as the web is moved onto and off of the turning roll. The blowbox assembly cooperates with the vacuum source (30) associated with the turning roll so that upon a reduction of the energy expended by the vacuum source associated with the turning roll, constant sub-atmospheric conditions can be maintained within the pocket region by increasing the expenditure of energy of the air-directing means by an amount which is less than the amount of the reduction of energy expended by the vacuum source.

15 Claims, 4 Drawing Sheets

PROCESS AND SYSTEM FOR PROMOTING COMPLETE WEB SUPPORT WITHIN THE DRYER SECTION OF A PAPERMACHINE

BACKGROUND OF THE INVENTION

This invention relates generally to papermachines and relates, more particularly, to the means and methods for preventing the separation of a paper web from a permeable carrier fabric as the web and fabric are transferred in concert between successive drying cylinders located within the dryer section of a papermachine.

The region of a papermachine with which this invention is concerned involves the inter-cylinder air pocket region located generally between a pair of adjacent drying cylinders and an adjacent turning roll around which a paper web and carrier fabric are moved as the web and fabric are moved through the dryer section of the papermachine. During a paper making operation during which the paper web and fabric are moved around this air pocket region, the paper web and carrier fabric are moved of f of the surface of one of the drying cylinders onto the surface of the turning roll, around the surface of the turning roll and then off of the surface of the turning roll onto the surface of the other of the adjacent drying cylinders.

The turning roll with which this invention is concerned includes an interior which is maintained at a low pressure, or sub-atmospheric, condition by a suitable vacuum source and includes a perforated surface around which the paper web and carrier fabric are moved so that the paper web is exposed to the low pressure condition of the roll interior through the perforations provided in the roll surface and the carrier fabric. The resulting difference in air pressure between the opposite sides of the paper web bias the web against the surface of the carrier fabric and, consequently, against the surface of the turning roll to reduce the likelihood of separation of the web from the fabric as the web and fabric are moved around the surface of the vacuum roll.

In order to reduce the likelihood of separation of the paper web from the run (i.e. the incoming run) of carrier fabric moved from one drying cylinder to the turning roll and from the run (i.e. the offgoing run) of carrier fabric moved from the turning roll to the next, or subsequent, drying cylinder, prior art arrangements have been developed for influencing the internal air pressure of the aforedescribed air pocket region. More specifically, such prior art arrangements are intended to establish and maintain the air pressure within selected areas of the pocket region at a sub-atmospheric condition so that the air pressure on the opposite side, i.e. the web-side, of the fabric/web runs biases the web against the surface of the carrier fabric.

One such arrangement, shown and described in U.S. Pat. No. 4,905,380, utilizes a combination blowbox/vacuum system for inducing a sub-atmospheric condition along the incoming and offgoing runs while advantageously effecting the vacuum capabilities of the turning roll. By comparison, another such arrangement, described in U.S. Pat. No. 5,279,049, relies upon the vacuum-induced sub-atmospheric condition of the interior of the turning roll to bias the web against the carrier fabric as the web/fabric arrangement is moved around the aforedescribed air pocket region. It would be desirable to provide an arrangement for inducing sub-atmospheric conditions within the aforedescribed air pocket region in a manner which, when used in conjunction with the vacuum source for inducing sub-atmospheric conditions within a turning roll, enables the energy requirements of the vacuum source to be reduced to such an extent that the total energy expenditure for satisfactorily biasing the web and carrier fabric against one another as the web and fabric move in concert around the pocket region and the turning roll is reduced.

Accordingly, it is an object of the present invention to provide a new and improved support system and an associated method for reducing the likelihood of separation of the paper web from the carrier fabric as the web and fabric are moved between successive drying cylinders wherein the system and method requires the expenditure of less energy than do prior art arrangements of this class.

Another object of the present invention is to provide such a system which primarily relies upon a blowbox system, rather than the vacuum source associated with the turning roll, for inducing a sub-atmospheric condition along the incoming and offgoing runs of the carrier fabric.

Still another object of the present invention is to provide such a system which requires no contact with moving components of the papermachine, is devoid of mechanical seals, and whose operation promotes cleanliness within the aforedescribed pocket region.

Yet another object of the present invention is to provide such a system which is uncomplicated in construction yet reliable and effective in operation.

SUMMARY OF THE INVENTION

This invention resides in a support system and associated process for use with the dryer section of a papermachine including a pair of adjacent drying cylinders which are separated by an air space and a turning roll situated adjacent the pair of drying cylinders for transferring a moving carrier fabric and paper web from the surface of one of the drying cylinders to the surface of the other of the drying cylinders as the carrier fabric and web are moved around the surface of the turning roll so that the carrier fabric is disposed between the paper web and the surface of the turning roll, wherein a pocket region is defined between the drying cylinders and the turning roll, wherein there is associated with the turning roll a vacuum source for inducing a sub-atmospheric condition within the interior of the turning roll, and wherein the turning roll includes a perforated surface to expose the paper web moving around the turning roll to the sub-atmospheric condition of the roll interior through the carrier fabric so that the paper web is biased against the surface of the turning roll as the web and carrier fabric are moved therearound.

The system includes means for directing air out of the pocket region to induce regions of sub-atmospheric conditions along an incoming run of the carrier fabric moving from the surface of one of the drying cylinders onto the surface of the turning roll and along an offgoing run of the carrier fabric moving from the surface of the turning roll to the surface of the other drying cylinder to reduce the likelihood of separation of the web from the carrier fabric as the web is moved with each of the incoming and offgoing runs of the carrier frabric and so that upon a reduction of the energy expended by the vacuum source associated with the turning roll, constant sub-atmospheric conditions can be maintained within the pocket region by increasing the expenditure of energy of the air-directing means by an amount which is less than the amount of the reduction of energy expended by the vacuum source.

The process of the invention includes steps performed with the system of the invention. More specifically, such steps include the directing of air generally away from the surface of the incoming run of the carrier fabric opposite the paper web and directing air generally away from the surface of the offgoing run of the carrier fabric opposite the paper web to induce regions of sub-atmospheric conditions along the incoming run and the offgoing run and to reduce the likelihood of separation of the web from the carrier fabric as the web is moved with each of the incoming and offgoing runs of the carrier fabric, reducing the energy expenditure of the vacuum source, and increasing the energy expenditure of the air-directing means to maintain the conditions along the incoming run and the offgoing run at a constant sub-atmospheric level.

DETAILED DESCRIPTION OF THE ILLUSTRATED EMBODIMENT

Figure 1:
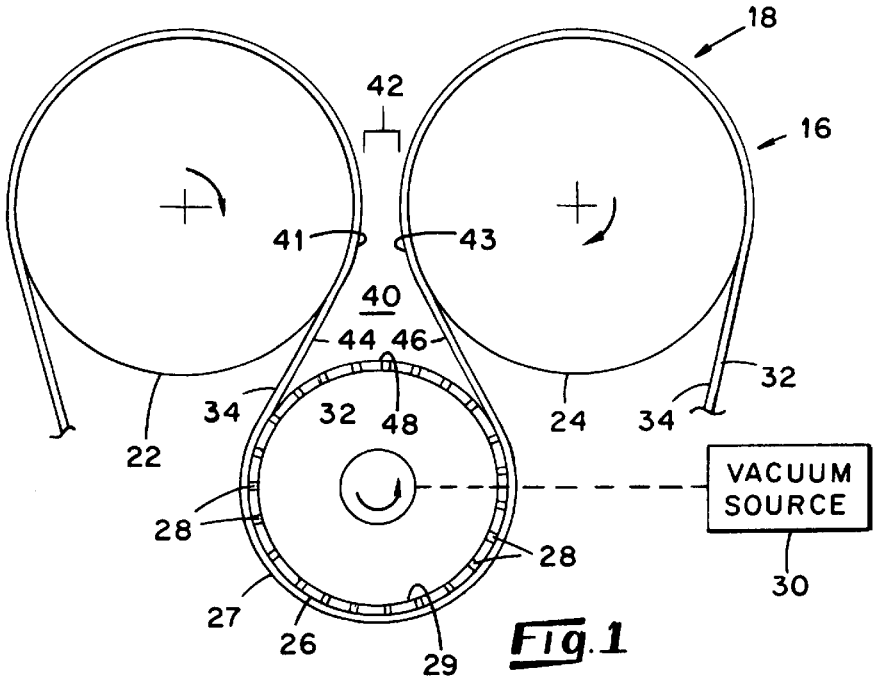
FIG. 1 is a schematic side view of a fragment of the dryer section of a papermachine, shown before installation of an embodiment of a system within which features of the present invention are incorporated.
Figure 2:
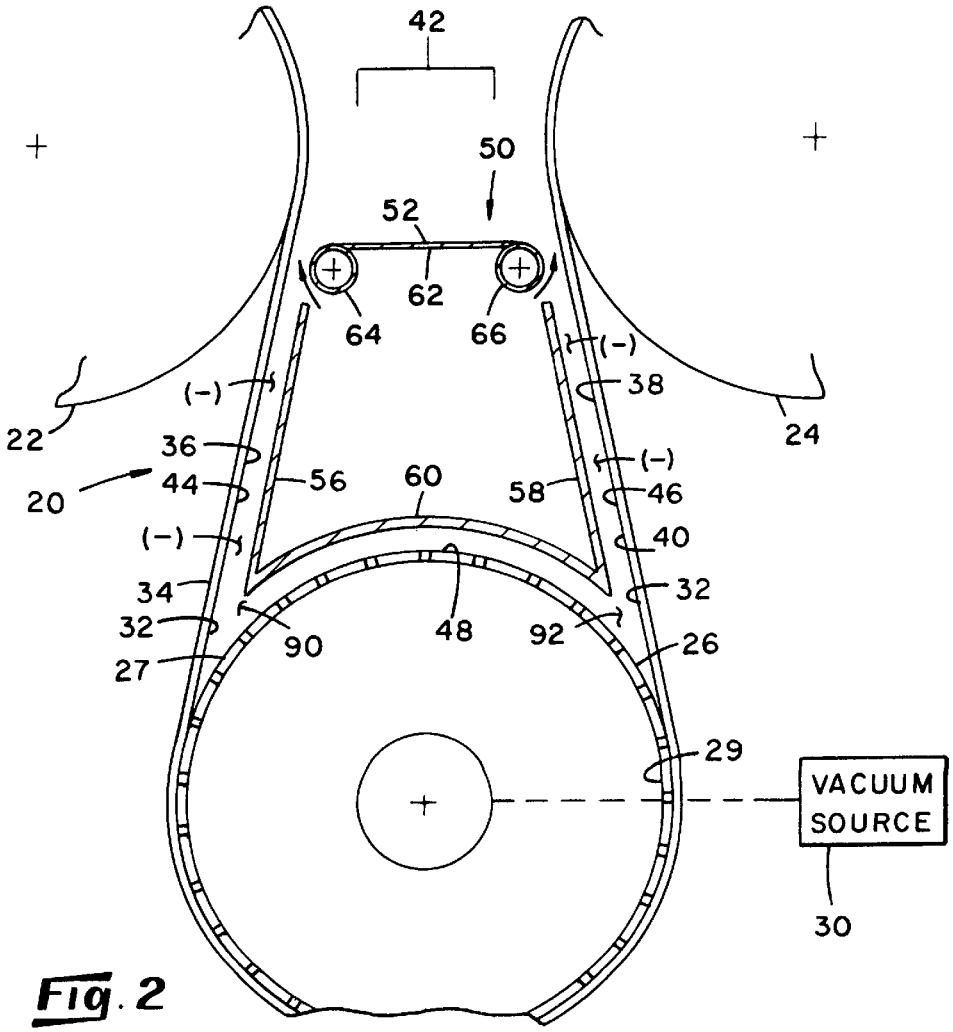
FIG. 2 is a schematic side view of the FIG. 1 fragment drawn to a slightly larger scale and shown after installation of an embodiment of a system within which features of the present invention are incorporated and wherein the blowbox assembly of the system embodiment is shown in transverse cross section.

Turning now to the drawings in greater detail, there is shown in FIGS. 1 and 2 an exemplary environment within which an embodiment of a support system, generally indicated 20 in FIG. 2, can be installed and utilized. In particular, the depicted FIG. 1 environment involves part of a dryer section 16 of a papermachine 18 and includes two adjacent, spaced drying cylinders 22 and 24 and a turning roll 26 disposed generally between and below the cylinders 22, 24 for rotation about parallel axes. The drying cylinders 22, 24 are stream or gas-heated and are commonly arranged, along with additional drying cylinders, in a horizontal row. The turning roll 26 has a peripheral surface 27 which is provided with radial bores, or perforations 28, which open out of the roll interior 29, and there is associated with the roll 26 a vacuum system 30 (which may include an industrial fan) which communicates with the interior of the roll 26 (by way of an end thereof) for maintaining the roll interior 29 at a low, or sub-atmospheric, pressure in a manner known in the art.

Within the dryer section 16, an air-permeable carrier fabric 32 and a paper web 34 are moved in concert with one another around the surface of one drying cylinder 22, then around the surface of the turning roll 26 and then around the surface of the other drying cylinder 24. Thus, the turning roll 26 serves to transfer the fabric 32 and web 34 between the surfaces of the drying cylinders 22 and 24 as the fabric 32 and web 34 are moved in sequence around the surface of the cylinder 22 and then around the surface of the cylinder 24. The carrier fabric 32 is comprised, for example, of air-permeable felt and is disposed in such a relation to the paper web 34 so that as the fabric/web arrangement is moved around each surface of the drying cylinders 22, 24, the web 34 is disposed between the cylinder surface and the carrier fabric 32 and so that as the fabric/web arrangement is moved around the surface of the turning roll 26, the fabric 32 is disposed between the surface of the roll 26 and the web 34.

As the carrier fabric 32 and web 34 are moved around the surface of the turning roll 26, the paper web 34 is exposed to the low pressure condition of the roll interior 29 through the permeable carrier fabric 32 and the perforations 28 provided in the roll surface 27 to bias the web 34 against the surface of the roll 26. By biasing the web 34 against the roll 26 in this manner, the likelihood that the web 34 will separate from the surface of the fabric 32 as the fabric/web arrangement is moved around the roll 26 is substantially reduced.

As will be described herein, the support system 20 (FIG. 2) is utilized within the FIG. 1 environment to reduce the likelihood of separation between the paper web 34 and the carrier fabric 32 as the web 34 and fabric 32 are moved off of one dryer cylinder 24 onto the surface of the turning roll 26 and as the web 34 and fabric 32 are subsequently moved off of the surface of the turning roll 26 and onto the surface of the next drying cylinder 24. At the same time, the support system 20 reduces the reliance upon the vacuum system 30 (used for inducing a sub-atmospheric condition within the roll interior 29) while biasing the web 34 against the fabric 32 as the fabric/web arrangement are moved between the cylinder 22 and the roll 26 and between the cylinder 24 and the roll 26 and reducing the overall energy expenditure of the support system 20 and vacuum system 30.

With reference still to FIG. 1, the carrier fabric 32 includes a section, or incoming run 44, which moves from the surface of the drying cylinder 22 and to the surface of the turning roll 26 and another section, or offgoing run 46, which moves from the surface of the turning roll 26 to the surface of the drying cylinder 24. As will be apparent herein, the blowbox system 20 (FIG. 2) is mounted within the inter-cylinder air pocket region, indicated 40 in FIG. 1, disposed generally between the drying cylinders 22, 24 and turning roll 26. This pocket region 40 is somewhat trapezoidal in cross section so as to be bounded on its sides by the incoming and offgoing runs 44 and 46, so as to be bounded on its upper side by the (air) space, indicated 42 in FIG. 1, which extends between the location, indicated 41, at which the carrier fabric leaves the surface of the drying cylinder 22 and the location, indicated 43 in FIG. 1, at which the carrier fabric moves onto the surface of the drying cylinder 24, and so as to be bounded along its lower side by the peripheral surface section, indicated 48, of the turning roll 26 which extends generally between the location thereon at which the incoming run 44 moves onto the turning roll 26 and the location thereon at which the offgoing run 46 moves off of the turning roll 26.

With reference again to FIG. 2, it is a feature of the support system 20 that it includes means, generally indicated 50, for directing air out of the pocket region 40 to induce and maintain the areas of the pocket region 40 disposed close to the incoming run 44 and offgoing run 46 in a low pressure, or more specifically, a sub-atmospheric condition. Within the depicted system 20, the desired sub-atmospheric condition is induced within the pocket region 40 by the directing of air away from the incoming run 44 on the side thereof opposite the web 34 to create a first zone of low (i.e. sub-atmospheric) pressure adjacent the incoming run 44 on the side thereof opposite the web 34 and by the directing of air away from the offgoing run 46 on the side thereof opposite the web 34 to create a first zone of low (i.e. sub-atmospheric) pressure adjacent the offgoing run 46' on the side thereof opposite the web 34. The resulting difference in air pressure which exists between the fabric side and the web side of the fabric/web of the effects a biasing of the web 34 against the carrier fabric 32 as the fabric/web arrangement moves between the drying cylinder 22 and the turning roll 26 and between the turning roll 26 and the drying cylinder 24.

Within the depicted system 20, the air-directing means 50 includes a blowbox assembly 52 having a pair of opposite side panels 56, 58 which are each supported in spaced and generally parallel relationship with a corresponding one of the incoming and offgoing runs 44 and 46 of the carrier fabric 32, a lower panel 60 which extends and is joined between the side panels 56, 58 and an upper panel 62 which extends between the side panels 56, 58 adjacent the upper ends thereof. End panels 68 (best shown in FIG. 3) extend across and are joined to the side panels 56, 58 at each end of the assembly 52. It follows that the interior of the blowbox assembly 52 is bounded by the aforedescribed panels 56, 58, 60, 62 and 68. Disposed along opposite edges of the upper panel 62 are cross-machine nozzles 64 and 66 (FIG. 2) for receiving pressurized air from an air supply (e.g. a high-pressure industrial fan) and for discharging the air through elongated slots formed along the length of the nozzles 64 and 66.

The operating principles of a blowbox are known so that a detailed description of such principles is not believed to be necessary. Suffice it to say that as streams of air are discharged from the nozzles 64 and 66 in directions generally away from the incoming and offgoing runs 44 and 46 of the fabric 32, air is drawn from the pocket region 40 so that a vacuum zone (i.e. a region of sub-atmospheric pressure) is created within the narrow gap, or spacing 36, located between the side panel 56 and the incoming run 44 and within the narrow gap, or spacing 38, located between the side panel 58 and the offgoing run 46. In the depicted assembly 52, the air which exits the nozzles 64 and 66 is forced generally upwardly along the surfaces of the runs 44 and 46 and out of the pocket region 40 through the air space 42 which separates the adjacent drying cylinders 22 and 24 from one another so that the boundary layer of air which normally moves along the surface of the moving web 32 as the web 32 moves into and out of the pocket region 40 is peeled away from the web surface 32 by the discharged air streams. The resulting difference in air pressure which exists on the side of the web 34 opposite the fabric 32 biases the web 34 against the fabric 32 and thereby helps to prevent a separation between the web 34 and the fabric 32 as the fabric/web arrangement move along each of the incoming and offgoing runs 44 and 46.

With reference still to FIG. 2, the lower panel 60 of the depicted blowbox assembly 52 which is joined between the lower edges of the side panels 56 and 58 is shaped generally complimentary to the surface of the turning roll 26. In addition, the lower panel 60 is supported in relatively close proximity to the surface of the roll 26 so as to span substantially the entire distance around the aforedescribed peripheral surface sector 48 of the roll 26 which extends between the location thereon at which the incoming run 44 moves onto the turning roll 26 and the location thereon at which the offgoing run 44 moves off of the roll 26.

Figure 3:
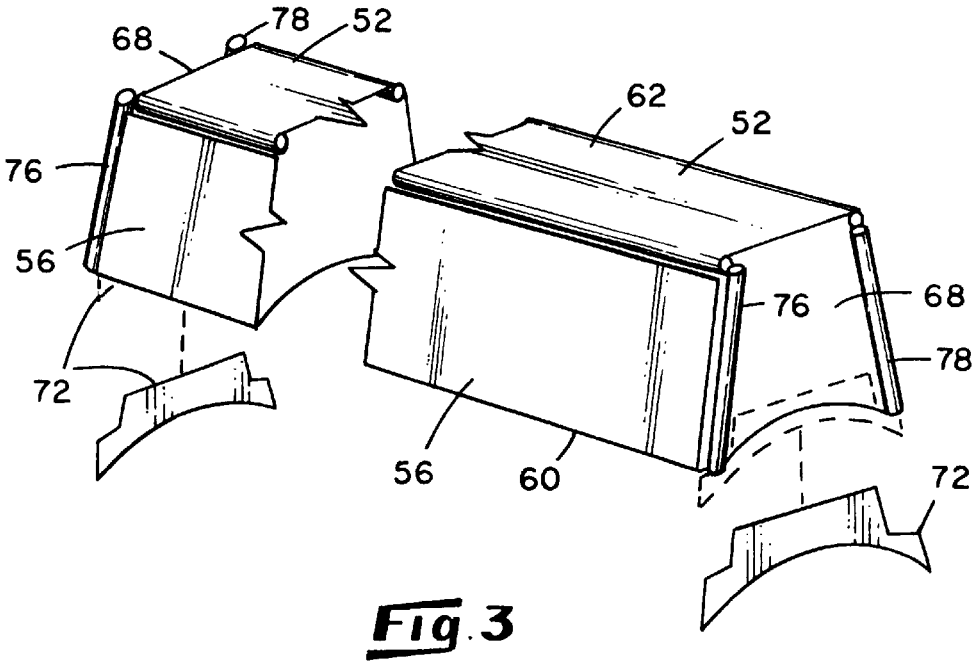
FIG. 3 is a fragmentary perspective view of an end section of the blowbox assembly of the FIG. 2 embodiment, shown exploded.
Figure 4:
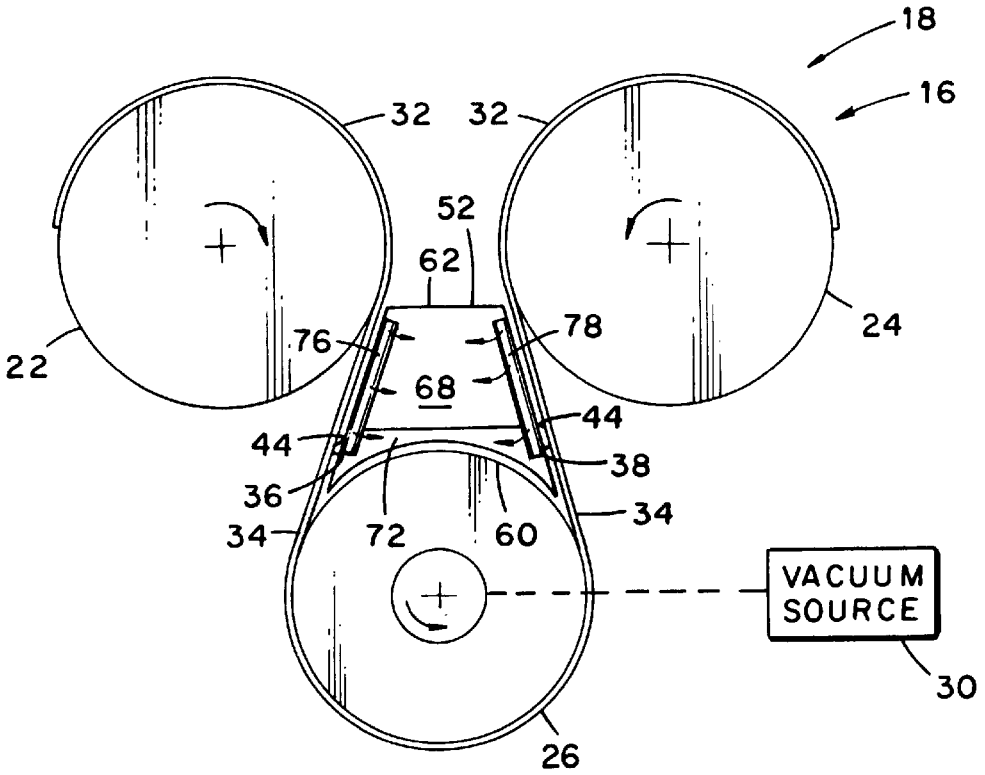
FIG. 4 is a schematic side view of the FIG. 1 fragment within which the FIG. 2 embodiment is incorporated and wherein the blowbox assembly of the system embodiment is shown from one end.

With reference to FIGS. 3 and 4, the blowbox assembly 52 also includes an arrangement of edge (machine-direction) nozzles 76, 78 mounted adjacent the side edges of the end panels 68 at each end of the assembly 52 for directing air away from the incoming and offgoing runs 44 and 46 at the (longitudinal) ends of the pocket region 40 where the sub-atmospheric spacing 36 provided between the side panel 56 and the incoming run 44 and the sub-atmospheric spacing 38 provided between the side panel 58 and the offgoing run 46 would otherwise be exposed to the atmospheric conditions surrounding, or outboard of, the papermachine 18. To this end, each edge nozzle 76 or 78 is mounted along an end of a corresponding side panel 56 or 58 so as to extend substantially the entire length therealong and is appropriately connected to a source of pressurized air for directing air away from the incoming and offgoing runs 44 and 46 and generally laterally with respect to the dryer section 16, as best shown in FIG. 4. Thus, the edge nozzles 76, 78 utilize blowbox air principles to reduce the internal air pressure adjacent the ends of the aforedescribed spacings 36 and 38 and thereby help maintain the air pressure within and along the aforedescribed spacings 36 and 38 at a sub-atmospheric condition.

Furthermore, an end nip plate 72 is fastened across each end panel 68 of the assembly 52 as shown in FIG. 3. Each of the opposite ends of the nip plate 72 terminates in a pointed section which is shaped generally complimentary to the shape (when viewed from one end) of a corresponding nip region within which the pointed section is positioned when the plate 72 is installed. (The nip regions of the pocket region 40 are the two regions of the pocket which are closest to the locations at which the fabric/web arrangement moves onto and then off of, respectively, the surface 48 of the turning roll 27 and are identified in FIG. 2 as 90 and 92.) When installed in place, the close proximity between the edges of the nip plate 72 and the adjacent surfaces of the turning roll 26 and the carrier fabric 32 help to seal the interior of the pocket region 40 from the atmospheric conditions surrounding the papermachine 18 and is advantageous in this respect.

It follows from the foregoing that a sub-atmospheric condition is maintained within the spacing 36 primarily by the directing of air out of the cross-machine nozzle 64 and the end nozzle 76 and that a sub-atmospheric condition is maintained within the spacing 38 primarily by the directing of air out of the cross-machine nozzle 66 and the end nozzle 78. Thus, the system 20 induces an under-pressurization of substantially the entire pocket region 40 for promoting complete web-to-fabric support as the web 34 is moved along the incoming and offgoing runs 36 and 38 without the use of a supplementary vacuum source (to induce sub-atmospheric conditions within the pocket region 40) and without the need for cross-machine mechanical seals. Furthermore, the active blowing of air from the system nozzles helps to maintain the area around the pocket region 40 relatively clean.

The system 20 has also been found to be particularly advantageous for reducing the total energy requirements necessary for maintaining the pocket region 40 in a sub-atmospheric condition when used in conjunction with the vacuum source 30 associated with the turning roll 26. For example, in order to maintain a desirable constant (sub-atmospheric) pressure within the pocket region 40, a compensation for the reduction in the pressure generated by the vacuum source 30 can be made by a less-than-corresponding increase in the pressure of the blowbox assembly nozzles. Similarly, an increase in the pressure of the blowbox assembly nozzles permits a more-than-corresponding reduction in the pressure generated by the vacuum source 30.

Figure 5:
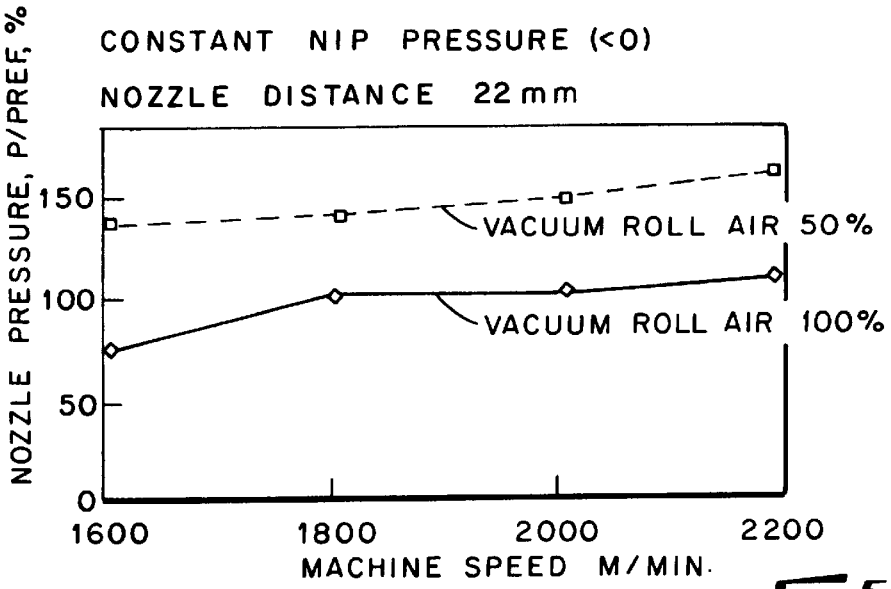
FIG. 5 is a graph of experimental test results plotting machine speed versus nozzle pressure as a function of the strength of the vacuum within the turning roll.
Figure 6:
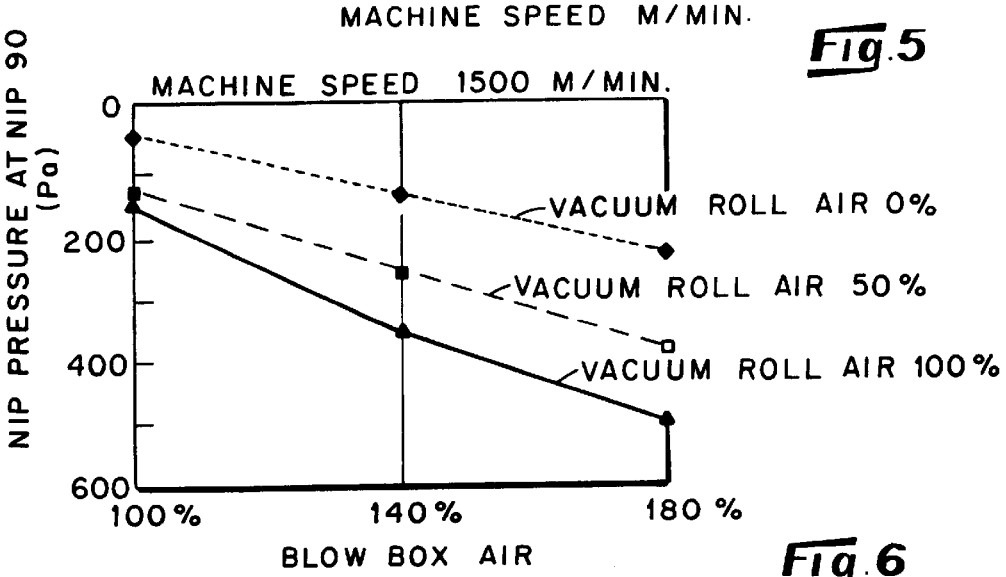
FIGS. 6 and 7 are graphs of experimental test results plotting the bloxbox air versus pressure as measured in a nip of the pocket region at various vacuum conditions induced within the turning roll.
Figure 7:
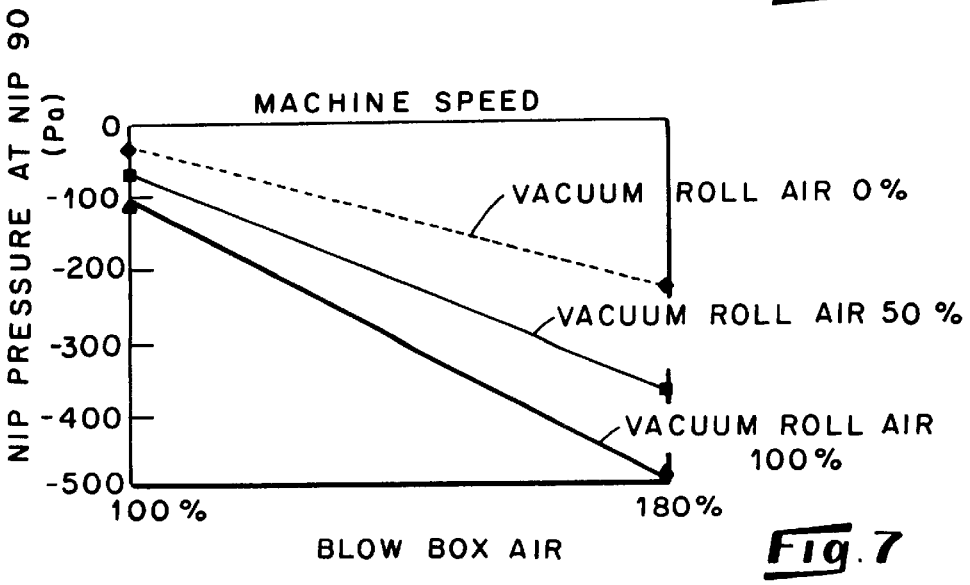
Figure 8:
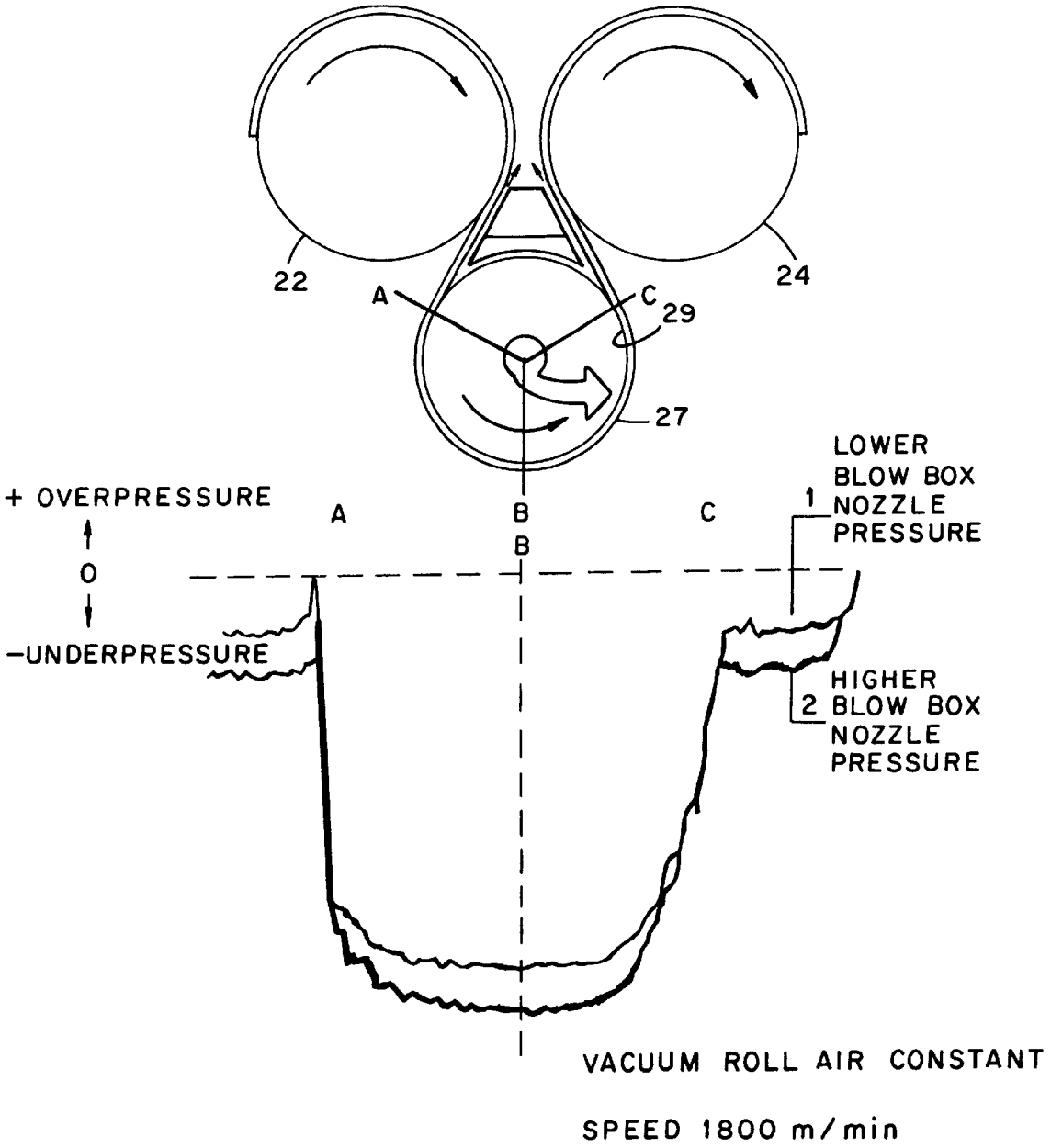
FIG. 8 is a plot of pressure curves for the vacuum roll as a path is traced around a segment of the surface of the roll.

The foregoing energy-related advantage has been confirmed with tests whose results are plotted in the graphs of FIGS. 5, 6 and 7 and was an unexpected result prior to the performance of these tests. In particular, within the FIG. 5 graph, there is plotted the necessary pressure of the blowbox assembly nozzles 64, 66 to maintain a constant (sub-atmospheric) pressure within the nip regions 90, 92 (FIG. 2) of the pocket regions 52 as a function of machine speed and contributions of the vacuum source 30. It can be seen from the FIG. 5 graph that in order to maintain a constant nip (sub-atmospheric) pressure at a machine speed of 1700 meters per minute, a fifty-percent reduction in the strength of the vacuum generated by the vacuum source necessitates an increase in the nozzle pressure of only about forty percent. Similarly, in order to maintain a constant nip (sub-atmospheric) pressure at a machine speed of 1800 meters per minute, a fifty-percent reduction in the strength of the vacuum generated by the vacuum source necessitates an increase in the nozzle pressure of only about forty-five percent.

Similarly, within the graphs of FIGS. 6 and 7, there is depicted the effect of an adjustment in the air volumes of the (vacuum) turning roll and the blowbox at the nip region 90 (FIG. 2) at machine speeds of 1500 m/minute and 1800 m/minute. In particular, the pressure (in pascals) measured within the nip region 90 is plotted along the ordinates of these graphs as a function of blowbox air volume and the turning roll air volume. It can be seen from these graphs that a reduction in the turning roll air volume from 100% to 56% at either of the machine speeds of 1500 or 1800 m/minute results in an change in the nip pressure which can be compensated for by a less-than-corresponding increase in the blowbox air flow. For example within the FIG. 6 graph, it can be seen that with the vacuum roll air at 100% and the blowbox air at 120% induces a nip pressure of about −250 Pa. If the vacuum roll air is reduced to 56%, the blowbox air would have to be increased by only [(140 minus 120)/120]× 100%, or about 17%, in order to maintain a constant nip pressure of about −250 Pa.

As far as the total power consumption is concerned (i.e. the combined expenditure of power by the blowbox nozzles and the vacuum source 30), in order to achieve a desired underpressure (i.e. a sub-atmospheric condition) across, for example, between the lower panel 60 and the surface 48 of the turning roll 26, it is beneficial to reduce the turning roll air amount as much as possible and compensate for this reduction by increasing the blowbox nozzle pressure. For example, to maintain a constant pocket pressure over a relatively broad range of machine speeds, a fifty percent reduction in the turning roll air flow will result in a fifteen to twenty-five percent lower total power consumption.

Therefore, over a relatively broad range of machine speeds, it is more energy-efficient, and consequently more cost-efficient, to induce (and strengthen, if necessary) sub-atmospheric conditions within the pocket region 40 by increasing the nozzle pressure at the blowbox assembly 52 rather than by increasing the strength of the vacuum generated by the vacuum source 30. Thus, the system 30 has the capacity to reduce the overall energy expenditure of the system 20 and vacuum source 30 in order to satisfactorily bias the carrier fabric 34 against the web 32 as the fabric/web arrangement moves between the drying cylinders 22 and 24, and the system 20 is advantageous in this respect.

Other testing and experimentation with the system 20 revealed that the system 20 is probably best suited for use with relatively tight machine geometries where underpressures can be practically achieved over substantially the entire pocket region, and that the pressure peak in the diverging (closing) nip region 90 is about 150 to 200 Pa higher than the average pocket pressure. Moreover, the pressure curve for the turning roll interior generally has the same shape for a variation in blowbox nozzle pressure, but the level, or magnitude, of the curve changes in response to a change in the blowbox nozzle pressure, as shown in the graph of FIG. 6.

It will be understood that numerous modifications and substitutions can be had to the aforedescribed embodiment without departing from the spirit of the invention. For example, although the lower panel 60 of the blowbox assembly 52 has been shown and described as being arcuate in shape, the lower panel 60 may be planar in form so as to extend straight between the lower edges of the side panels 56 and 58. Accordingly, the aforedescribed embodiments are intended for the purpose of illustration and not as limitation.

What is claimed is:

1. A support system for use with the dryer section of a papermachine including a pair of adjacent drying cylinders each having a surface which are separated by an air space and a turning roll having an interior and a surface situated adjacent the pair of drying cylinders for transferring a moving carrier fabric and paper web from the surface of one of the drying cylinders to the surface of the other of the drying cylinders as the carrier fabric and web are moved around the surface of the turning roll so that the carrier fabric is disposed between the paper web and the surface of the turning roll, wherein a pocket region is defined between the drying cylinders and the turning roll, wherein there is associated with the turning roll a vacuum source for inducing a sub-atmospheric condition within the interior of the turning roll, and wherein the turning roll includes a perforated surface to expose the paper web moving around the turning roll to the sub-atmospheric condition of the turning roll interior through the carrier fabric so that the paper web is biased against the surface of the turning roll as the web and carrier fabric are moved therearound, the system comprising:

a blowbox assembly including means for directing air out of the pocket region to induce regions of sub-atmospheric conditions along an incoming run of the carrier fabric moving from the surface of one of the drying cylinders onto the surface of the turning roll and along an offgoing run of the carrier fabric moving from the surface of the turning roll to the surface of the other of the drying cylinders to reduce the likelihood of separation of the web from the carrier fabric as the web is moved with each of the incoming and offgoing run of the carrier fabric and so that upon a reduction of the energy expended by the vacuum source associated with the turning roll, constant sub-atmospheric conditions can be maintained within the pocket region by increasing the expenditure of energy of the air-directing means by an amount which is less than the amount of the reduction of energy expended by the vacuum source.

2. The system as defined in claim 1 wherein the blowbox assembly includes a blowbox having panels disposed adjacent the incoming run, the offgoing run and said peripheral surface of the turning roll, and nozzle means associated with the blowbox for directing air out of the pocket region to induce regions of sub-atmospheric conditions between the incoming run and a corresponding one of the blowbox panels and between the offgoing run and another corresponding one of the blowbox panels.

3. The system as defined in claim 2 wherein each of the pair of drying cylinders and the turning roll has two ends and a length as measured between the two ends, and the pocket region extends along the length of the pair of drying cylinders and the turning roll between which the pocket region is defined and terminates adjacent the ends of the drying cylinders and the turning roll, and the blowbox assembly further includes:

an end panel joined to and extending between the blowbox panels adjacent the ends of the drying cylinders and turning roll; and the means for directing air further includes edge nozzles mounted upon the panels of the blowbox for directing air laterally out of the pocket region at the ends of the drying cylinders and the turning roll to help maintain the sub-atmospheric conditions along the incoming run and along the offgoing run.

4. A support system for use with the dryer section of a papermachine including a pair of adjacent drying cylinders having surfaces which are separated by an air space and a turning roll having an interior and a surface situated adjacent the pair of drying cylinders for transferring a moving carrier fabric and paper web from the surface of one of the drying cylinders of the pair of drying cylinders to the surface of the other of the drying cylinders of the pair of drying cylinders as the carrier fabric and web are moved around the surface of the turning roll so that the carrier fabric is disposed between the paper web and the surface of the turning roll, wherein a pocket region is defined between the drying cylinders and the turning roll which is bounded by a) an incoming run of the carrier fabric moving from the surface of one of the drying cylinders onto the surface of the turning roll, b) an offgoing run of the carrier fabric moving from the surface of the turning roll to the surface of the other drying cylinder, c) a peripheral surface section of the turning roll which extends generally between the location thereon at which the incoming run moves onto the turning roll and the location thereon at which the offgoing run moves off of the turning roll, and d) the space extending between the locations on the adjacent drying cylinders at which the carrier fabric leaves the surface of one of the drying cylinders and moves onto the surface of the other drying cylinder, wherein there is associated with the turning roll a vacuum source for inducing sub-atmospheric conditions within the interior of the turning roll, and wherein the turning roll includes a perforated surface to expose the paper web moving around the turning roll to the sub-atmospheric condition of the turning roll interior through the carrier fabric so that the paper web is biased against the surface of the turning roll as the web and carrier fabric are moved therearound, the system comprising:

a blowbox assembly including a blowbox having panels disposed adjacent the incoming run, the offgoing run and said peripheral surface of the turning roll, and means associated with the blowbox for directing air away from the incoming run and the offgoing run to induce regions of sub-atmospheric conditions between the incoming run and one of the blowbox panels and between the offgoing run and another of the blowbox panels thereby enabling the energy expended by the vacuum source associated with the turning roll to maintain sub-atmospheric condition within the interior of the turning roll to be reduced as the energy expended by the air directing means of the blowbox assembly is increased by an amount which is less than the reduction in energy of the vacuum source.

5. The system as defined in claim 4 wherein the incoming run has a surface opposite the paper web, and the blowbox panels include:

a first side panel having a surface extending along and opposing the surface of the incoming run opposite the paper web so as to provide the first panel and the incoming run with opposing surfaces and a first gap between the opposing surfaces of the first panel and the incoming run; and a second side panel extending along the offgoing run opposite the paper web so as to provide a second gap between the opposing surfaces of the first panel and the incoming run, and the means for directing air includes cross-machine nozzles for directing air through the air spacing which separates the adjacent drying cylinders to maintain a sub-atmospheric pressure within the first and second gap.

6. The system as defined in claim 5 wherein each of the pair of drying cylinders and the turning roll includes two ends and a length as measured between the two ends, and the pocket region extends along the length of the pair of drying cylinders and the turning roll between which the pocket region is defined and terminates at two opposite ends wherein each end of the pocket region is disposed adjacent a corresponding end of the drying cylinders and the turning roll, and the blowbox assembly further includes:

an end panel joined to and extending between the first side panel and second side panel adjacent each end of the pocket region; and the means for directing air further includes edge nozzles disposed at each end of the pocket region for directing air laterally out of the pocket region at the ends of the drying cylinders and the turning roll to help maintain the sub-atmospheric condition between the first side panel and the incoming run and between the second side panel and the offgoing run.

7. The system as defined in claim 6 wherein the blowbox assembly includes two edge nozzles mounted at each end of the pocket region, and each of said two edge nozzles is joined to an end panel so as to extend along a corresponding edge of the first side panel and second side panel.

8. A web-to-fabric support system for use within the dryer section of a papermachine including a pair of adjacent drying cylinders each having a surface and a turning roll having an interior and a surface wherein a moving carrier fabric and paper web is transferred from the surface of one of the drying cylinders to the surface of the other of the drying cylinders as the carrier fabric and web are moved around the surface of the turning roll with the carrier fabric disposed between the paper web and the surface of the turning roll and wherein a pocket region is defined generally between the drying cylinders and the turning roll and is bounded by an incoming run of the carrier fabric moving from the surface of one of the drying cylinders onto the surface of the turning roll, an offgoing run of the carrier fabric moving from the surface of the turning roll to the surface of the other drying cylinder and a peripheral surface section of the turning roll which extends generally between the location thereon at which the incoming run moves onto the turning roll and the location thereon at which the offgoing run moves off of the turning roll, wherein there is associated with the turning roll a vacuum source for inducing a sub-atmospheric condition within the interior of the turning roll, and wherein the surface of the turning roll is perforated so that the paper web moving around the turning roll is exposed to the sub-atmospheric condition of the roll interior through the carrier fabric and the surface of the turning roll and thereby biased against the surface of the turning roll as the web and carrier fabric are moved therearound, the system comprising:

a blowbox assembly including means for directing air away from the surface of the incoming run of the carrier fabric opposite the paper web to maintain a region of sub-atmospheric pressure adjacent the surface of the incoming run opposite the paper web and for directing air away from the surface of the offgoing run of the carrier fabric opposite the paper web to maintain a region of sub-atmospheric pressure adjacent the surface of the offgoing run opposite the paper web and to thereby reduce the likelihood of separation of the web from the carrier fabric as the web is moved with each of the incoming and offgoing run of the carrier fabric onto and off of the turning roll; and the blowbox assembly and the vacuum source associated with the turning roll cooperate with one another so that upon a reduction in the energy expended by the vacuum source to maintain sub-atmospheric conditions within the roll interior, constant sub-atmospheric conditions can be maintained adjacent the surfaces of the incoming and offgoing runs as aforesaid by increasing the energy expenditure of the air-directing means of the blowbox assembly by an amount which is less than the reduction of energy expended by the vacuum source.

9. The system as defined in claim 8 wherein the incoming run has a surface opposite the paper web, and the blowbox includes:

a first side panel having a surface extending along and opposing the surface of the incoming run opposite the paper web so as to provide the first panel and the incoming run with opposing surfaces and a first gap between the opposing surfaces of the first panel and the incoming run; and a second side panel extending along the offgoing run opposite the paper web so as to provide a second gap between the opposing surfaces of the first panel and the incoming run, and the means for directing air includes cross-machine nozzles for directing air through the air spacing which separates the adjacent drying cylinders to maintain a sub-atmospheric pressure within the first and second gaps.

10. The system as defined in claim 9 wherein each of the pair of drying cylinders and the turning roll has two ends and a length as measured between the two ends, and the pocket region extends along the length of the pair of drying cylinders and the turning roll between which the pocket region is defined and terminates adjacent the ends of the drying cylinders and the turning roll, and the blowbox assembly further includes:

an end panel joined to and extending between the first side panel and second side panel adjacent the ends of the drying cylinders and turning roll; and the means for directing air further includes edge nozzles for directing air laterally out of the pocket region at the ends of the drying cylinders and the turning roll to help maintain the sub-atmospheric condition between the first side panel and the incoming run and between the second side panel and the offgoing run.

11. The system as defined in claim 10 wherein the first and second side panels have ends, and the edge nozzles are joined to the end panel so as to extend along the ends of the first side panel and second side panel.

12. In combination with a dryer section of a papermachine including a pair of adjacent drying cylinders each having a surface which are separated by an air space and a turning roll having a surface situated adjacent the pair of drying cylinders for transferring a moving carrier fabric and paper web from the surface of one of the drying cylinders to the surface of the other of the drying cylinders as the carrier fabric and web are moved around the surface of the turning roll with the carrier fabric disposed between the paper web and the surface of the turning roll and wherein a pocket region is defined between the adjacent drying cylinders and the turning roll which is bounded by a) an incoming run of the carrier fabric moving from the surface of one of the drying cylinders onto the surface of the turning roll, b) an offgoing run of the carrier fabric moving from the surface of the turning roll to the surface of the other of the drying cylinders, c) a peripheral surface section of the turning roll which extends generally between the location thereon at which the incoming run moves onto the turning roll and the location thereon at which the offgoing run moves off of the turning roll, and d) the space extending between the locations on the drying cylinders at which the carrier fabric leaves the surface of one of the drying cylinders and the location at which the carrier fabric moves onto the surface of the other of the drying cylinders, wherein the turning roll includes an interior and a perforated surface, and wherein there is associated with the turning roll a vacuum source for inducing a sub-atmospheric condition within the interior of the turning roll and so that the paper web moving around the turning roll is exposed to the sub-atmospheric condition of the roll interior through the carrier fabric so that the paper web is biased against the surface of the turning roll as the web and carrier fabric are moved therearound, a support system comprising:

a blowbox assembly including means for directing air away from the surface of the incoming run of the carrier fabric opposite the paper web and for directing air away from the surface of the offgoing run of the carrier fabric opposite the paper web to reduce the likelihood of separation of the web from the carrier fabric as the web is moved with each of the incoming and offgoing run of the carrier fabric; and wherein the blowbox assembly cooperates with the vacuum source associated with the turning roll so that upon a reduction in the energy expended by the vacuum source associated with the turning roll, constant sub-atmospheric condition can be maintained within the pocket region by increasing the expenditure of energy of the air-directing means by an amount which is less that the reduction of energy expended by the vacuum source.

13. A process for promoting complete web-to-fabric support in a dryer section of a papermachine having a pocket region provided generally between a pair of adjacent drying cylinders each having a surface which are separated by an air space and a turning roll having a surface situated adjacent the pair of drying cylinders for transferring a moving carrier fabric and paper web from the surface of one of the drying cylinders to the surface of the other of the drying cylinders as the carrier fabric and web are moved around the surface of the turning roll with the carrier fabric disposed between the paper web and the surface of the turning roll, wherein said pocket region is bounded by a) an incoming run of the carrier fabric moving from the surface of one of the drying cylinders onto the surface of the turning roll, b) an offgoing run of the carrier fabric moving from the surface of the turning roll to the surface of the other drying cylinder and c)

a peripheral surface section of the turning roll which extends generally between the location thereon at which the incoming run moves onto the turning roll and the location thereon at which the offgoing run moves off of the turning roll, and d) the air space extending between the locations on the drying cylinders at which the carrier fabric leaves the surface of one of the drying cylinders and the location at which the carrier fabric moves onto the surface of the other drying cylinder, wherein the turning roll includes an interior and is perforated, and wherein there is associated with the turning roll an vacuum source for inducing a sub-atmospheric condition within the interior of the roll so that the paper web moving around the turning roll is exposed to the sub-atmospheric condition of the roll interior through the carrier fabric so that the paper web is biased against the surface of the turning roll as the web and carrier fabric are moved therearound, the process comprising the steps of:

directing air generally away from the surface of the incoming run of the carrier fabric opposite the paper web and directing air generally away from the surface of the offgoing run of the carrier fabric opposite the paper web to induce regions of sub-atmospheric condition along the incoming run and the offgoing run and to reduce the likelihood of separation of the web from the carrier fabric as the web is moved with each of the incoming and offgoing runs of the carrier fabric;

reducing the energy expenditure of the vacuum source; and increasing the energy expenditure of the air-directing means to maintain the condition along the incoming run and the offgoing run at a constant sub-atmospheric level.

14. The process as defined in claim 13 wherein the step of directing air includes the step of directing air out of the pocket region by way of the air space which separates the adjacent drying cylinders.

15. The process as defined in claim 14 wherein each of the pair of drying cylinders and the turning roll include two ends and a length as measured between the two ends, and the pocket region extends along the length of the pair of drying cylinders and the turning roll between which the pocket region is provided and terminates adjacent the ends of the drying cylinders and the turning roll, and the step of directing air further includes a step of directing air laterally out of the pocket region and past the ends of the drying cylinders and the turning roll.

* * * * *